US006213362B1

(12) United States Patent
Lorenzini et al.

(10) Patent No.: US 6,213,362 B1
(45) Date of Patent: Apr. 10, 2001

(54) SLING-TYPE INFANT CARRIER

(76) Inventors: Ann L. Lorenzini; Peter A. Christopher, both of P.O. Box 43, Johnson, VT (US) 05656

( * ) Notice: Subject to any disclaimer, the term of this patent is extended or adjusted under 35 U.S.C. 154(b) by 0 days.

(21) Appl. No.: 09/167,194

(22) Filed: Oct. 6, 1998

Related U.S. Application Data

(60) Provisional application No. 60/060,950, filed on Oct. 6, 1997.

(51) Int. Cl.[7] ..... A61G 1/00
(52) U.S. Cl. ..... 224/158; D3/214
(58) Field of Search ..... 224/158, 159, 224/160; D3/213, 214

(56) References Cited

U.S. PATENT DOCUMENTS

| | | | | |
|---|---|---|---|---|
| D. 306,655 | | 3/1990 | Schegel Liebert . | |
| D. 332,865 | | 2/1993 | Wilmink . | |
| D. 407,213 | * | 3/1999 | McConnell | D3/213 |
| 484,065 | * | 10/1892 | Taylor | 224/160 |
| 3,575,326 | * | 4/1971 | Chappell | 224/159 |
| 4,434,920 | * | 3/1984 | Moore | 224/160 |
| 4,469,259 | | 9/1984 | Krich et al. | 224/160 |
| 4,492,326 | | 1/1985 | Storm | 224/160 |
| 4,579,264 | * | 4/1986 | Napolitano | 224/158 X |
| 4,750,653 | * | 6/1988 | Prunty | 224/158 X |
| 4,757,925 | | 7/1988 | Knittel | 224/158 |
| 4,986,458 | | 1/1991 | Linday | 224/160 |
| 5,246,152 | * | 9/1993 | Dotseth | 224/158 X |
| 5,333,769 | | 8/1994 | Skroski | 224/158 |
| 5,573,156 | | 11/1996 | McConnell | 224/158 |
| 5,857,598 | * | 1/1999 | Dunne | 224/158 |
| 5,950,887 | * | 9/1999 | Powell | 224/159 X |

FOREIGN PATENT DOCUMENTS

| | | | | |
|---|---|---|---|---|
| 2371906 | * | 7/1978 | (FR) | 224/158 |
| 2662339 | * | 11/1991 | (FR) | 224/158 |
| 607133 | * | 8/1948 | (GB) | 190/103 |

* cited by examiner

*Primary Examiner*—Gregory M. Vidovich

(57) ABSTRACT

An infant carrier with a sling body (12) capable of expanding as an infant grows in size. The infant carrier (10) is positioned on the front of the adult's torso. Newborns are positioned in a natural, supportive womb-like posture and as the infant grows in size and musculature they can sit be in a more upright position. Padded top bands (14,16) supply comfort and a structure to the upper edge of the sling body. Structural straps (18,19) eliminate stretch and offer strength along the upper horizontal region of the sling body means. The sling body means (17) is fixedly attached to a wide shoulder pad means (20). Adjustment to the infant carrier (10) is performed using an adjustable shoulder strap (30), a common loop (34) and a bar slide (32). Alternative hardware can be utilized that allows for variations in adjustment as well as removably attaching the shoulder pad means (20) to the sling body means (17).

12 Claims, 8 Drawing Sheets

SLING-TYPE INFANT CARRIER

This application claims the benefit of Provisional Application 60/060,950 filed Oct. 6, 1997.

BACKGROUND

1. Field of Invention

This invention relates to soft, sling-type infant carriers designed to be worn across the user's front upper body.

2. Discussion of Prior Art

Human survival can in part be attributed to the ability of adults to carry infants using their hands. This ability has allowed our species to protect our vulnerable children in the event of predation or other dangers. As humans became involved in foraging and eventually agriculture the necessity to carry children in other ways became paramount. Women as primary care takers needed to be able to use their hands and perform necessary tasks while carrying their infants. In order for work to be accomplished mothers needed to be able to have hands free. The infants needed the security and the ability to nurse as this work was being accomplished.

Today, the ability to carry infants is seen as an opportunity for adults to do necessary tasks, while also nurturing their child. Adults have work to do and infant carriers enable this work to be accomplished with both hands. Infants genetically are still living in the distant past and emotionally need the direct connection to parental security that carrying offers.

Prior art for carrying infants has been primarily broken into two approaches: vertical carriers and horizontal or sling-type carriers. Research today suggests that horizontal carriers are best for young infants that have not yet acquired the musculature to remain seated. Vertical carriers place a large amount of stress on the vertebral column of young infants. The infant's muscular development is simply not able to support the head and upper torso.

The alternative to this approach is a sling-type carrier. Being a more womb-like environment weight is distributed to a larger surface area. Early approaches to slings have focused on relatively wide blankets of fabric that wrap around the wearer's torso. These slings are bulky and difficult to wear and young infants tend to get lost inside the large cloth sling.

These slings have tended to utilize a pair of rings or the like to fasten the sling about the upper body of the wearer. This approach to fastening the sling has allowed the slings to use large fabric blanks, but has tended to keep the slings bulky and blanket-like. The full body wrapping effect of these slings is difficult to wear and unappealing to many adults.

Recently, an approach has been made to increase the usability of slings for both infants and adults (see U.S. Pat. No. 4,757,925). There are several limiting factors in this approach as well: the fabric is woven so that the sling size and shape is still on the large and bulky side, the shoulder pad is narrow creating ineffective weight distribution, the baby carrier does not offer structural padding at the upper edges of the sling.

Prior art has been forced by design to use woven fabrics that do not offer stretch. This forces the manufacturer to produce a sling that is of a maximum size. This has made them very large for newborn infants who tend to appear lost in the large fabric blanks.

The present invention's use of stretch fabrics has allowed for a sling that starts out small and expands with the infant. As the infant grows the sling is able to stretch in the cradle area beneath structural straps allowing the sling to get larger. This sling supports the infant's development with the stretchable fabric by allowing the newborn to be in a fetal position and still be in visual contact with the adult. As the infant develops they are able to sit up and look out, observe and participate.

SUMMARY OF THE INVENTION

A sling-type infant carrier with the shoulder pad fixedly attached to the sling body and to an adjustable strap. The sling body assembly consists of a body, two bands, two structural straps and batting. The two bands are differing in length with the band positioned closest the wearer shorter in length than that surrounding the infant. This provides a tailored fit for the adult and a cradle for the infant.

The top bands are fixedly attached surrounding the batting material or the like. The padded top bands offer the infant's head support and protection. In addition the padded bands and the structural straps give the sling body assembly a structure not found in prior art. The structural straps offer the sling body assembly rigidity along the upper horizontal margin to both limit the amount of stretch for the sling body and also to create a solid structure for carrying the infant.

The sling body assembly's shorter back top band and sewn in gathering creates a sling that contains a shorter uppermost length adjacent the wearer's body. The longer front top band allows for a bow shaped cradle while the short top band forms a tailored fit on the adult. The bow shaped cradle creates room for the infant. The tailored fit about the adult facilitates for unobstructed contact with the infant. The sling body and bands are constructed of fabrics capable of stretching that are soft, strong and flexible. For colder climates and weather fabrics, such as, polyester fleece can be used to impart the ideal combination of strength, stretch and warmth. Warmer regions or seasons can utilize thinner, cooler fabrics. The fabric's stretch characteristics can be accommodated by varying the sling body size. Very stretchy fabrics require a smaller sling body size.

The sling body assembly is fixedly attached to a substantially wide shoulder pad assembly. The direct attachment of the sling body assembly to the substantially wide shoulder pad allows for greater weight distribution than can be accomplished by using the Knittel method (Pat. No. 4,757,925) of mounting a shoulder pad onto a strap. The pad is designed for the left shoulder to place the infant's head close to the wearer's heart. The pad can also be designed to be for use on the right shoulder if needed. Future possibilities can be to use hardware to allow for removably fixing the shoulder pad for either right or left shoulder usage. Hardware can be used that also allows for front strap length adjustment and front buckling/unbuckling.

The shoulder pad cover can be constructed of a fabric that is strong and flexible. The shoulder pad contains a padding material. The shoulder pad assembly is fixedly attached on its rear side to an adjustable strap. The adjustable strap is adjustably attached to the rear side of the sling body assembly. Future possibility is a strap adjustment that offers the option of using either shoulder for support.

The main object of the invention is to create a sling-type infant carrier that is of improved fit and comfort for the infant and the adult wearer. The preferred embodiment of the infant sling contains: a soft, stretch fabric for the sling body, padded upper bands and structural straps for comfort and support.

Improved fit for the infant is achieved by the use of stretch fabrics, differing length padded top bands and gatherings of the sling. The stretch of the fabric is controlled by the combination of the fabric blank size, the padded top bands, the gatherings, and the structural straps. The top bands and the structural straps do not allow for significant stretch to occur along the top margin of the sling body. Thus, the sling body has expansion ability below the top margin and the sling has the necessary amount of strength and integrity.

The body of the sling starts out small and expands as the infant develops from a fetal position to a sitting position as the infant's musculature is able. The newborn is held comfortably in a womb type position and the adult can see and connect with the infant. As the infant grows the sling is able to stretch in the cradle area beneath the structural straps, allowing the sling to comfortably support a larger infant in seated positions.

Another object of the present invention was to create an infant carrier in which the infant and adult can be in visual contact with each other. The bow shaped cradle and padded top bands create a carrier that is open along the top edges to allow for eye contact and easy access with the adult. The infant is readily accessible for the adult—physically and visually.

Another object of the present invention was to provide an infant carrier that was comfortable for the adult. The direct attachment of the shoulder pad assembly to the sling body assembly has an advantage for comfortably carrying the infant's weight. The shoulder pad has a larger area of effective weight distribution than can be accomplished by using a shoulder strap mounted shoulder pad.

Another object of the present invention was to provide an infant carrier that was simple to use. The single adjustment on the strap means is all that is necessary for properly setting up the carrier. The sling body assembly is tailored to fit both the infant and the adult and does not require any adjustment at all.

Another object of the present invention was to create an infant carrier that both men and women feel comfortable wearing. Prior art slings have tended to be primarily suited to be worn by women. The tailored body of the sling and the lack of the blanket-like effect clearly make the present invention acceptable to both men and women.

A preferred embodiment of the invention will now be described by way of example and with reference to the accompanying drawings.

Figure 1:
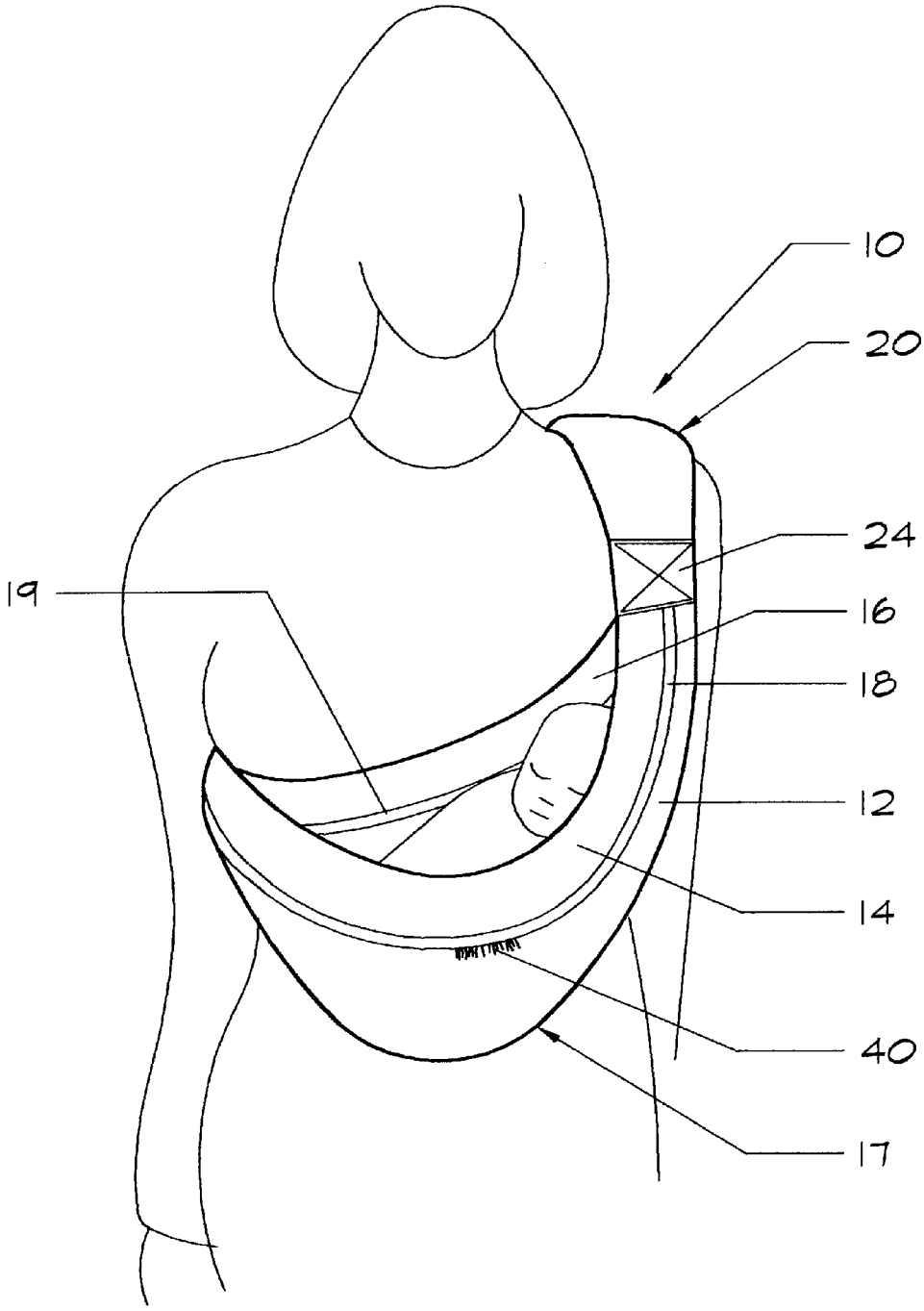
FIG. 1 is a perspective view of the infant carrier in use with a newborn infant.

| Drawing Reference Numerals Worksheet | |
|---|---|
| 10 | carrier apparatus |
| 12 | sling body |
| 14 | front top band |
| 16 | back top band |
| 17 | sling body means |
| 18 | front structural strap |
| 19 | back structural strap |
| 20 | shoulder pad means |
| 22 | shoulder pad cover |
| 24 | shoulder pad attachment |
| 26 | shoulder pad attachment |
| 28 | sling body attachment |
| 30 | support strap, long |
| 32 | bar slide |
| 34 | common loop |
| 36 | support strap, short |
| 40 | gathers |
| 42 | batting |
| 44 | foam insert |
| 50 | shoulder pad, outer margin |
| 52 | shoulder pad, inside margin |
| 54 | adjustable buckle-male |
| 56 | non-adjustable buckle-male |
| 58 | buckle-female |

DETAILED DESCRIPTION

Figure 1A:
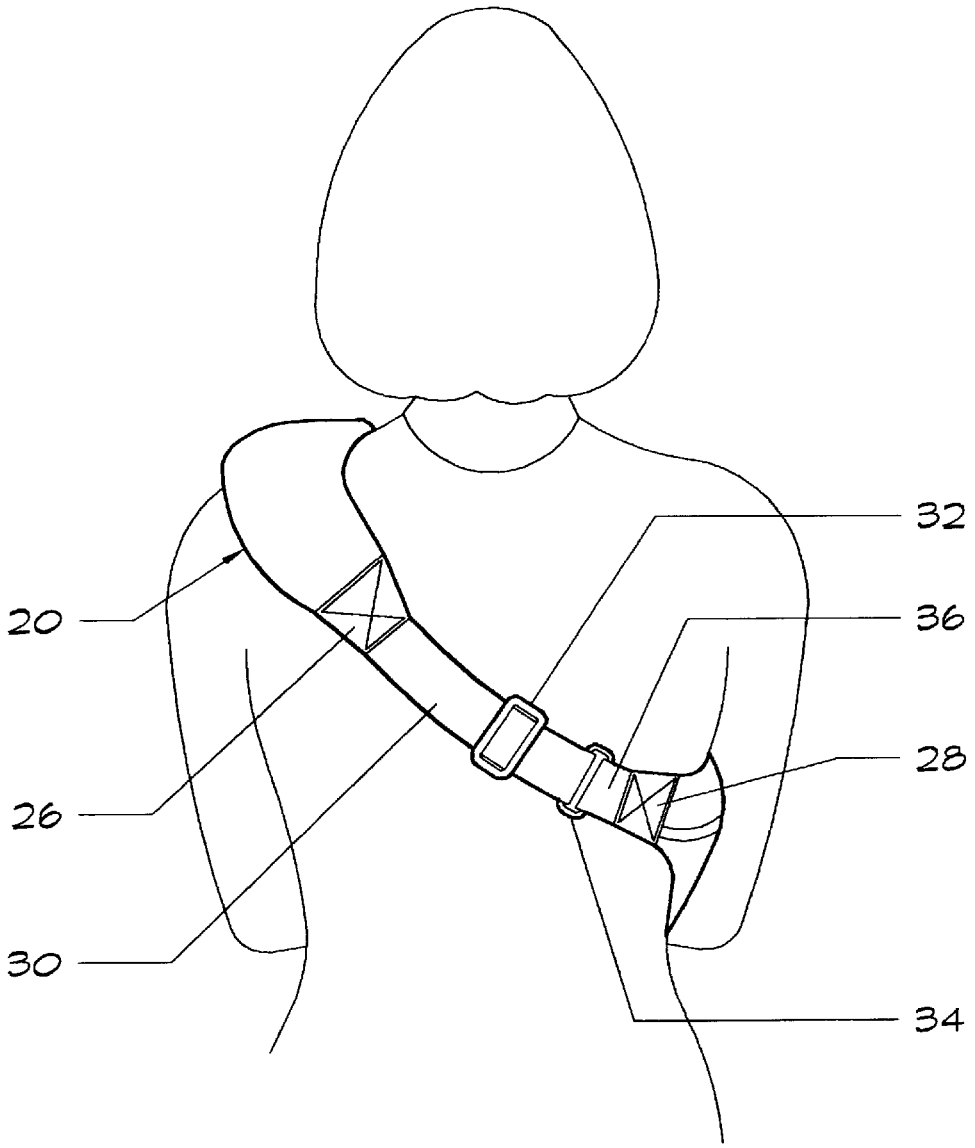
FIG. 1A is a perspective view of the infant carrier in use taken from the back view of the user.
Figure 2:
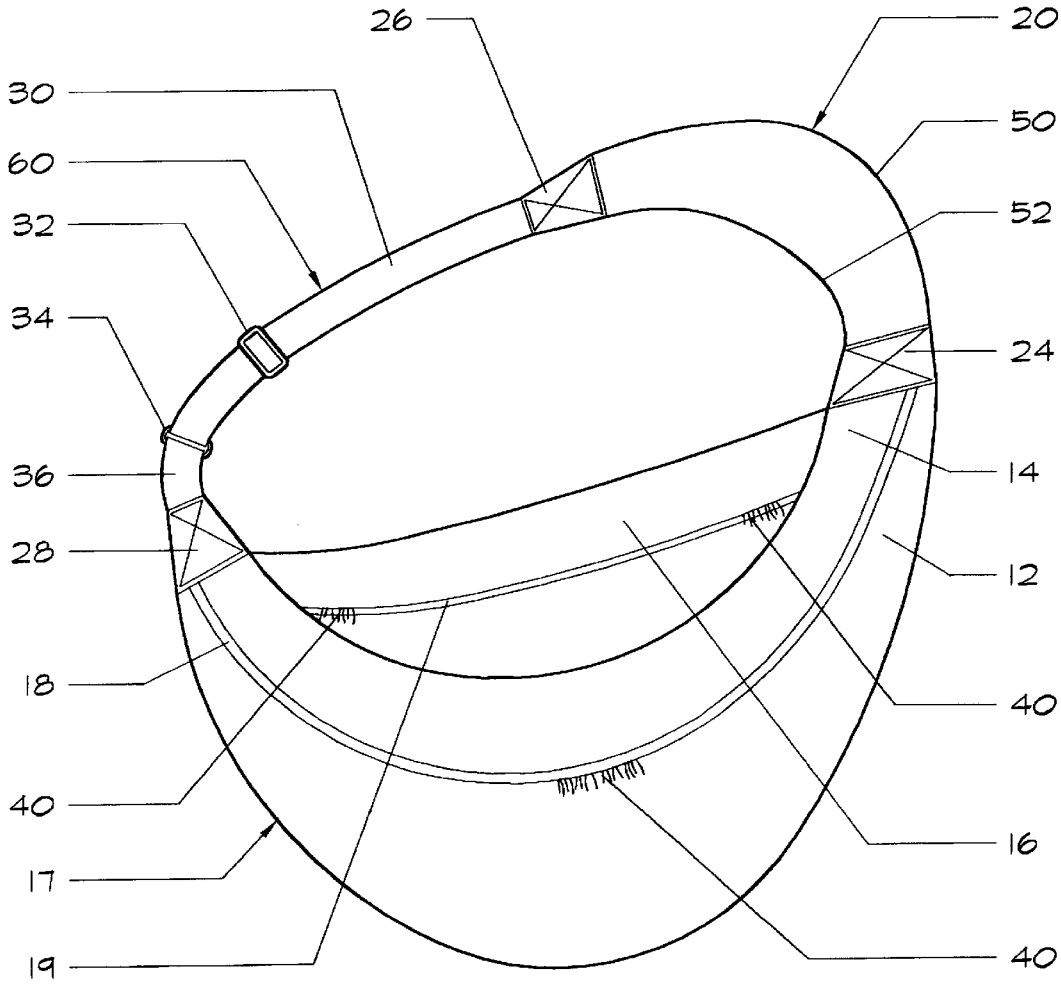
FIG. 2 is a perspective view of the infant carrier in an open position.

An infant carrier 10 includes a sling body 12 with its padded top bands 14,16, structural straps 18,19, a shoulder pad 20 and strap assembly, as shown in FIGS. 1, 1A, and 2. The sling body 12, padded top bands 14,16 and structural straps are sewn together. The top bands encase a padding material, such as batting (See FIG. 3). The arrangement of the sling body 12, the top bands 14,16 and the structural straps 18,19 is such that the sling body assembly 17 attains an arcuate configuration (See FIG. 1).

The sling body assembly's shape is achieved by using a shorter back top band 16 than front top band 14. The arcuate configuration is also achieved by utilizing gathers 40 sewn into the sling body during the attachment of the top bands (See FIG. 2). The structural straps 18,19 are sewn on after the sling body, top band and gathering process (See FIGS. 1 and 2). The arcuate configuration of the sling creates a tailored fit surrounding the adult's torso. It also creates a cradle for the infant (FIGS. 1 and 10).

Figure 10:
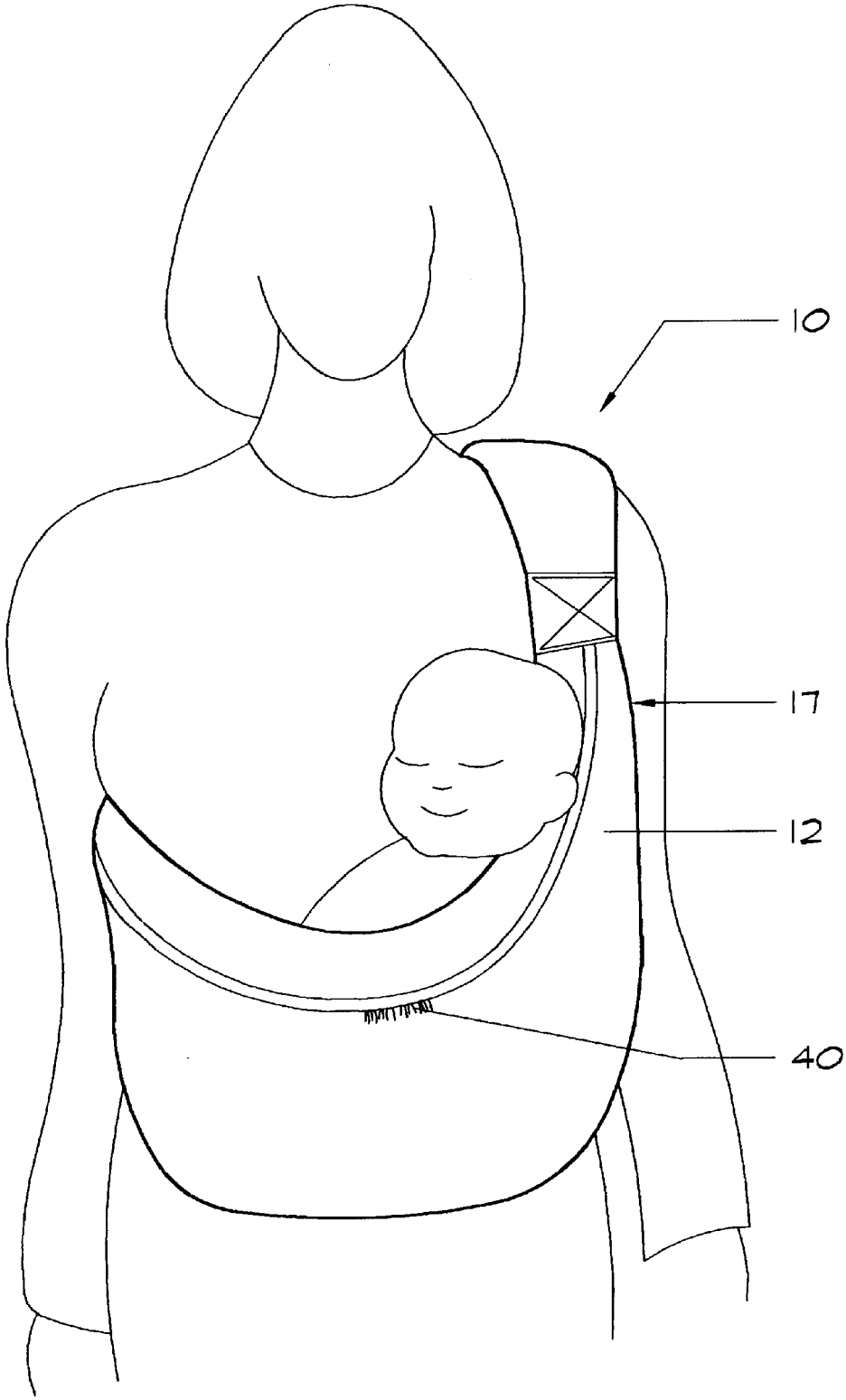
FIG. 10 is a perspective view of the infant carrier in use with a larger infant illustrating expansion of sling body size.

The sling body 12 can be made of a fabric that is capable of a significant amount of stretch (FIG. 10). The top bands 14,16 may be made of a fabric that may or may not stretch. The top bands 14,16 if using a stretch fabric may use the fabric in such a way that the stretch of the fabric is reduced. The structural straps 18,19 can be made of any strong strap such as grosgrain ribbon, tapestry tape or the like. The structural straps need to have an insignificant amount of stretch and have considerable strength The padded top bands 14,16 give the sling body assembly 17 a structure not found in prior art. The structure allows for ease of baby placement within the sling. The structure also leaves the sling open along the top margin for the adult and infant to have visual contact with each other (See FIGS. 1 and 10). The infant is reassured with direct contact with the adult.

The shoulder pad assembly 20 is constructed of a cover 22 sewn to enclose a padding material 44. The shoulder pad assembly contains an arcuate shape with the longest peripheral axis being along the outside margin 50 (See FIGS. 1, 1A and 2). The shorter margin 52 is closest to the wearer's neck. The design allows for as wide a shoulder pad as possible to be utilized for maximum weight distribution.

Figure 3:
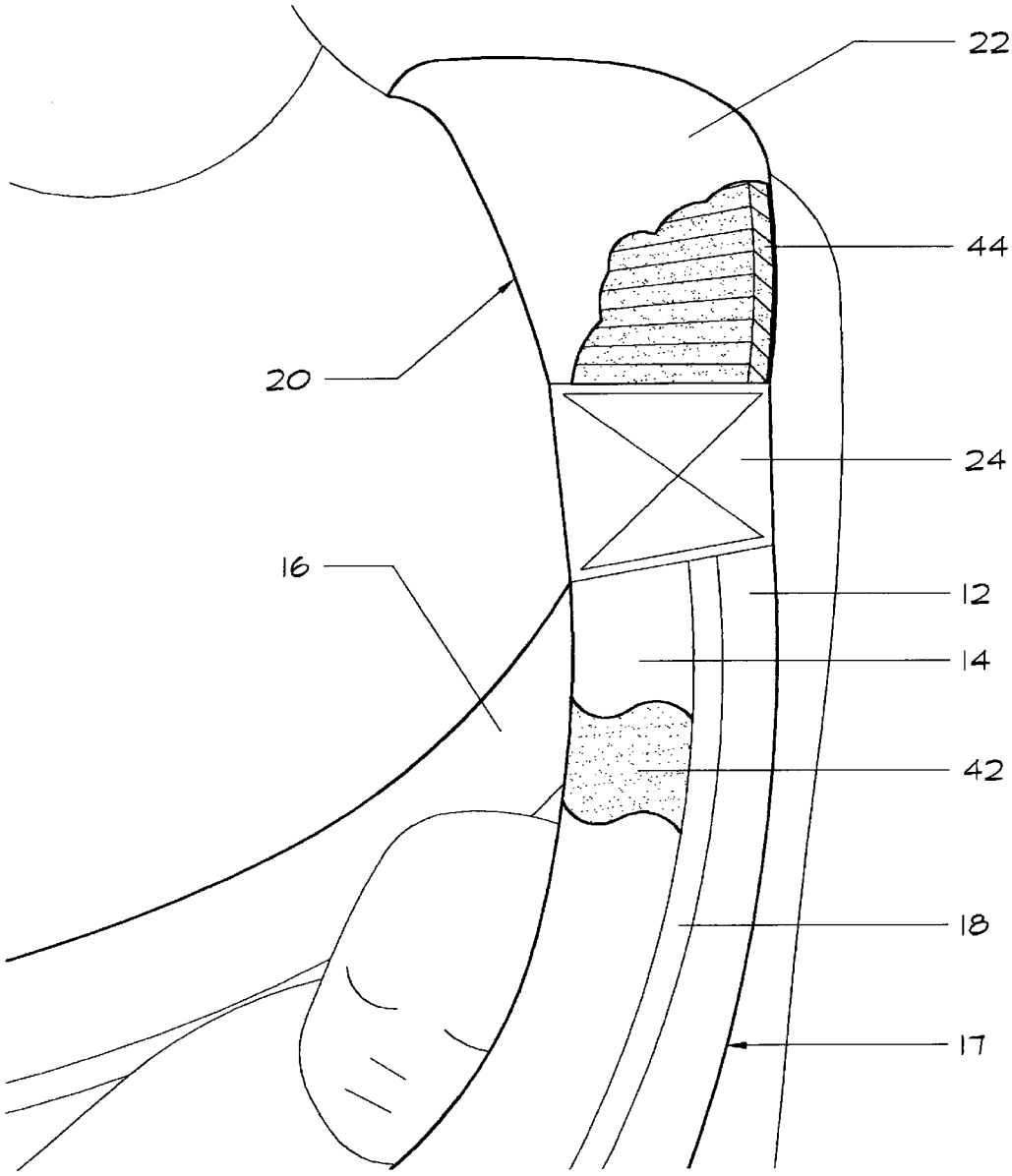
FIG. 3 is a fragmentary detail view of the shoulder pad means illustrating attachment to the sling body means with cutaways illustrating the padding in the shoulder pad means and batting material in the top bands.

The shoulder pad assembly 20 is fixedly attached to the sling body assembly with shoulder pad attachment 24, as shown in FIGS. 2 and 3. The sling body assembly is folded to fit into the attachment 24 and sewn. The back side of the shoulder pad assembly 20 is attached to the shoulder strap 30 with shoulder pad attachment 26. These three layers are sewn together. The arrangement of the shoulder pad assembly being sewn directly to the sling body assembly 17 creates an infant carrier that positions the infant's head close to the wearer's heart. This placement creates a restful environment for the infant. The direct attachment of the shoulder pad assembly 20 to the sling body assembly also allows for greater weight distribution than can be accomplished by using a shoulder strap mounted shoulder pad.

Figure 4:
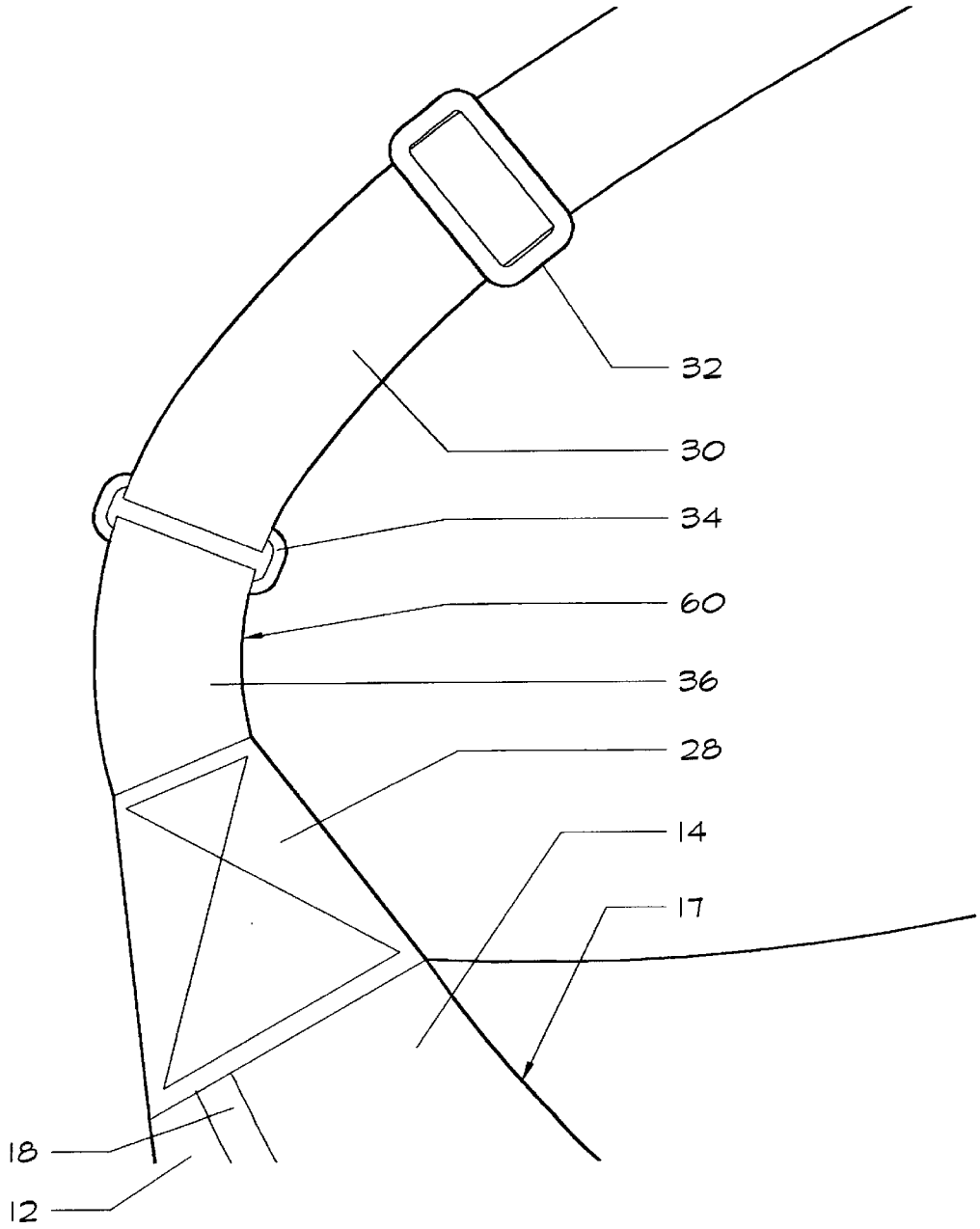
FIG. 4 is a fragmentary detail view of the sling body means illustrating attachment to the adjustment strap.
Figure 5:
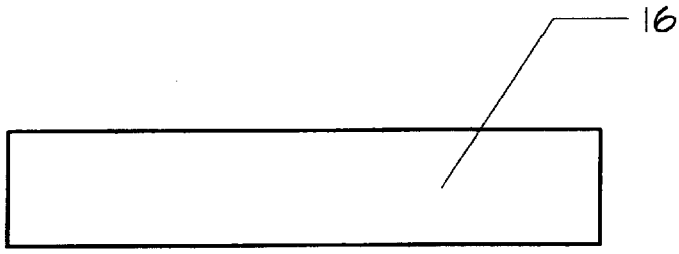
FIG. 5 is a plan view of the back top band.
Figure 6:
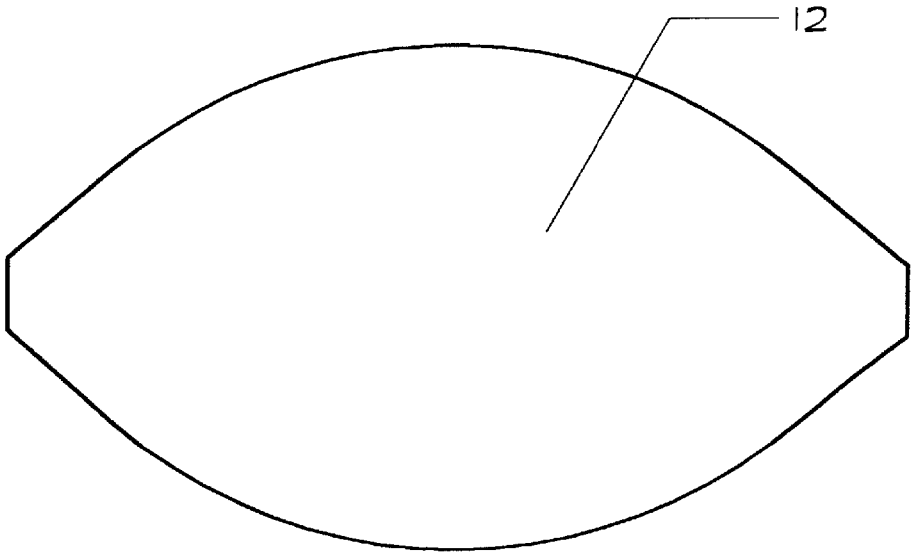
FIG. 6 is a plan view of the sling body.
Figure 7:
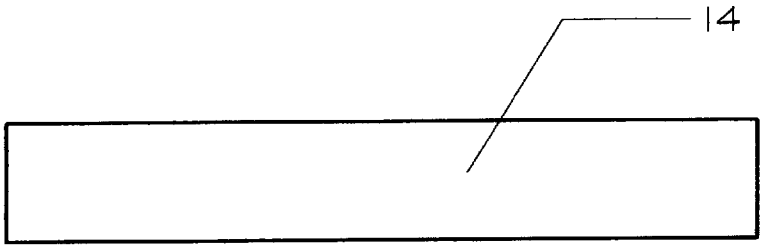
FIG. 7 is a plan view of the front top band.

The shoulder strap consists of a long strap 30, a bar slide 32, a common loop 34 and a short support strap 36 (See FIGS. 2 and 4). The short support strap 36 is fixedly sewn to the body of the sling using attachment piece 28. The attachment pieces 24,26,28 are constructed of a strong, flexible fabric. The coupling and adjustment of the support straps is accomplished using respectively, a common loop 34 and a bar slide 32 (see FIGS. 1A and 5). The support straps 30,36 can be made of any strong strap. The use of the straps and adjustment/coupling hardware allows for ease of adjustment and security for the infant.

Figure 8:
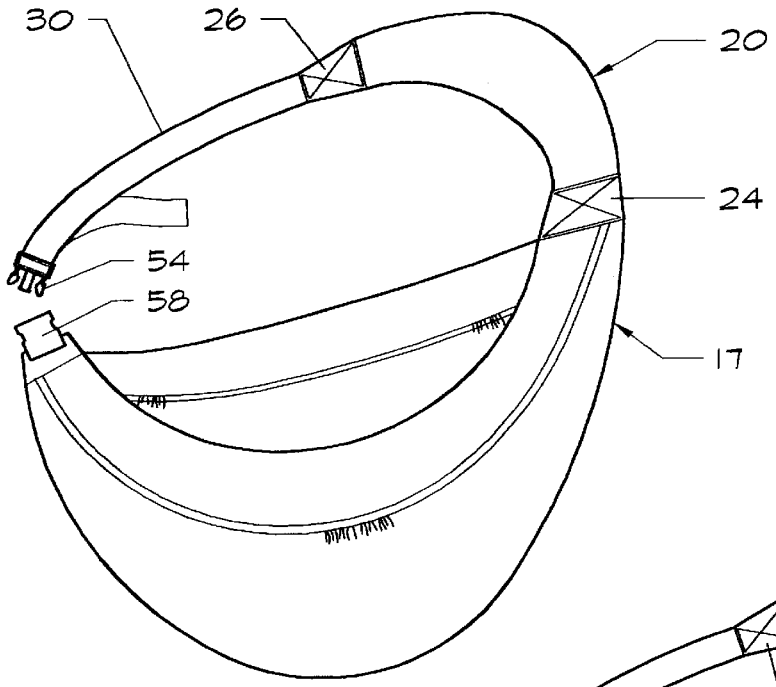
FIG. 8 is a fragmentary detail view of the sling body means illustrating attachment to an adjustable buckle.
Figure 9:
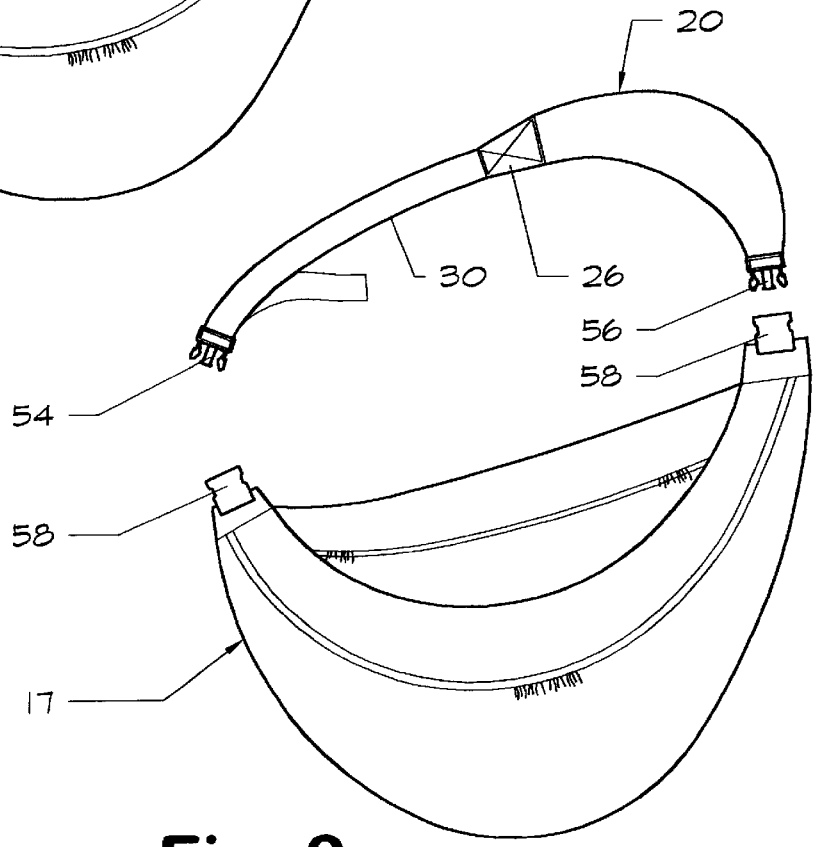
FIG. 9 is a plan view of the infant carrier fitted with two buckles for removably attaching the shoulder pad means to the sling body means, shoulder pad may be used for either shoulder.

The sling body assembly 17 design lends itself to further innovative and useful hardware usage. The sling body assembly can remain identical to present invention and be fitted with hardware variations to create a front adjustable sling that can be removed by unbuckling (See FIG. 8) or that can be used on either shoulder (See FIG. 9). These simple modifications can be useful for breast feeding or for people that want or require a product that can be used on either shoulder.

The advantage of a front adjustable buckle (See FIG. 8) can be that the wearer can tighten or loosen the sling without taking it of. The buckle can further allow the adult to remove the sling without sliding the strap over their head. The double buckle approach (FIG. 9) allows for the wearer to choose the shoulder for carrying the child. This again may be helpful for breast feeding and also for either left or right handed adults.

It is therefore to be understood that various modifications and changes in the construction and arrangement of parts comprising the preferred embodiment of the present invention may be made without departing from the spirit and scope there of as defined by the, to be added, appended claims.

We claim:

1. A sling-type infant carrier consisting of:

a) a sling body means adapted to be located across the torso of an adult, said sling body means further comprises a sling body having first and second ends, and substantially elliptical opposed sides, wherein said opposed sides of said sling body form a cavity for receiving an infant and further form a rim of said sling body means.

b) an adjustable adjustment strap assembly for attachment to said first and second ends, and said adjustment strap assembly having a shoulder pad means;

c) said shoulder pad means for disposing about the upper torso of the adult;

d) said sling body means further comprising a means for support to be non-movably connected along the length of each of said opposed sides and spaced below said rim, whereby said sling body has expansion ability below said support means and said sling body means has the necessary amount of strength and integrity.

2. An infant carrier according to claim 1, wherein said sling body is fixedly attached at attachment sites substantially near said opposed sides to a front and a back top band and further includes a predetermined number of gathers.

3. An infant carrier according to claim 2, wherein said front and back top bands have two distinct lengths, said front top band having a first length and said back top band having a second length shorter than said first length of said front top band.

4. An infant carrier according to claim 3, wherein said front and back top bands further surround a batting material.

5. An infant carrier according to claim 4, wherein said shoulder pad means is fixedly attached to said first end of said sling body means using a first shoulder pad means attachment that surrounds a portion of said shoulder pad means and said first end of said sling body means.

6. An infant carrier according to claim 5, wherein said shoulder pad means, said first end of said sling body means and said first shoulder pad means attachment are fastened together.

7. An infant carrier according to claim 6, wherein an adjustment strap is fixedly attached to said shoulder pad means using a second shoulder pad means attachment that surrounds a portion of said adjustment strap and a portion of said shoulder pad means.

8. An infant carrier according to claim 7, wherein said adjustment strap, said shoulder pad means and said second shoulder pad means attachment are fastened together.

9. An infant carrier according to claim 8, wherein said adjustment strap is adjustably attached to said second end of said sling body means using a bar slide.

10. An infant carrier according to claim 9, wherein said second end of said sling body means includes a sling body means attachment surrounding said second end of said sling body means and a portion of a loop of strap operatively connected with said bar slide.

11. An infant carrier according to claim 9, wherein said loop of strap further includes a common loop operatively connecting said loop of strap with said bar slide.

12. An infant carrier according to claim 11, wherein said second end of said sling body means, said sling body means attachment and said loop of strap are fastened together.

* * * * *